US005184934A

United States Patent [19]

Gallo

[11] Patent Number: 5,184,934

[45] Date of Patent: Feb. 9, 1993

[54] GRIPPING DEVICE AND METHOD OF USE

[76] Inventor: Antonio Gallo, R.R. #5, Caledon East, Ontario, Canada, L0N 1E0

[21] Appl. No.: 727,868

[22] Filed: Jul. 10, 1991

[51] Int. Cl.[5] ..... B66C 3/04

[52] U.S. Cl. ..... 414/740; 52/122.1; 52/741.1; 125/12; 125/35; 294/67.22; 294/67.5; 294/103.1; 414/10; 414/622; 414/786; 414/792.9

[58] Field of Search ..... 414/724, 744, 722, 621, 414/622, 10, 792.9, 631, 740, 786; 52/122.1, 741; 294/67.22, 67.5, 67.33, 103.1; 125/35, 12

[56] References Cited

U.S. PATENT DOCUMENTS

| | | | |
|---|---|---|---|
| 3,349,933 | 10/1967 | Simpson et al. | 414/724 |
| 3,669,293 | 6/1972 | Bryan et al. | 414/740 X |
| 3,749,437 | 7/1973 | Lynn | 294/67.22 X |
| 4,266,819 | 5/1981 | Pemberton | 414/740 X |
| 4,431,083 | 2/1984 | York | 414/631 X |
| 4,489,970 | 12/1984 | Henke | 294/67.22 |
| 4,714,393 | 12/1987 | Betts | 414/10 |

FOREIGN PATENT DOCUMENTS

| | | | |
|---|---|---|---|
| 2003627 | 9/1970 | Fed. Rep. of Germany | 52/741 |
| 8802606 | 5/1990 | Netherlands | 52/122.1 |

*Primary Examiner*—Michael S. Huppert
*Assistant Examiner*—Donald W. Underwood
*Attorney, Agent, or Firm*—Sim & McBurney

[57] ABSTRACT

A gripping device for use in combination with a front-end loader for lifting and transporting heavy objects, comprising a slot-entering jaw means, second jaw means, jaw adjusting means to effect movement of one of said slot-entering jaw means and said second jaw means relative to other of said jaw means, and loader cooperation means by which said device is adapted to cooperate with the loader. The device is particularly useful for removing slabs of concrete from a pre-cut concrete floor, such as found in multi-storey parking garages, during demolition or rehabilitation.

7 Claims, 4 Drawing Sheets

GRIPPING DEVICE AND METHOD OF USE

FIELD OF THE INVENTION

This invention relates to a gripping device for use with a front-end loader in lifting heavy objects, particularly concrete slabs obtained in rehabilitation of multi-storey structures.

BACKGROUND OF THE INVENTION

Large expanses of concrete flooring such as is found in multi-level car parks are after a period of time, due to deterioration, in need of repair, in whole or in part.

Replacement of significant areas of concrete flooring has in one method involved the chipping and breaking up of the concrete by means of pneumatic hammers. This piecemeal breakup is messy, noisy and results in relatively small pieces of loose concrete.

An alternative method presently in use involves the more favourable practise of cutting by means of a concrete cutter of the, typically, 8" to 12" (0.2 m–0.3 m) thick concrete floor into rectangular slabs of concrete. Typically, the concrete floor is carved into rectangular blocks, for example, 8'×3'×8" (2.4 m×0.95 m×0.2 m) or 4'×4'×8" (1.2 m×1.2 m)×0.2 m) slabs, with removal of each individual slab being carried out using the forks of a fork-lift truck stationery on the floor below the cut floor. The forks are held aloft of the loader and positioned below and adjacent to the slab to be cut such that after the cutting operation the slab is levered onto the forks. This method is not satisfactory since the raised forks abut the slab to be removed prior to cutting. This is inherently dangerous since there is the possibility that the very heavy concrete slab could either miss or fall off the forks and cause personal injury or equipment damage. Accordingly, there is a need for a safer method of slab removal.

SUMMARY OF THE INVENTION

It is an object of the present invention to provide a gripping device for concrete slab removal which permits use of a front-end loader operative on the concrete floor to be removed, and, thus, obviating the requirement for an operator to be beneath the cut slab.

It is a further object of the invention to provide a speedier method of rehabilitating concrete floors.

Accordingly, the present invention provides in its broadest aspect a gripping device for use in combination with a front-end loader in gripping and lifting a heavy object said device comprising slot-entering jaw means, second jaw means, jaw adjusting means to effect movement of one of said slot-entering jaw means and said second jaw means relative to the other of said jaw means, and loader cooperation means by which said device is adapted to cooperate with said loader.

By the term "slot-entering jaw means" in this disclosure and claims is meant jaw means adapted to enter a narrow opening between adjacent and preferably rectangular shaped, objects. Typically, slot widths of up to 2" (5.0 cm) are contemplated in the broadest aspect of this invention, but the device according to the invention has greater applicability with slot widths of less than 1" (2.54 cm) and still greater applicability for widths of approximately ⅛" (3 mm).

Preferably, the second jaw means are adjustable relative to the slot-entering jaw means and said adjusting means are second jaw adjusting means to effect movement of said second jaw means away from or towards said slot-entering jaw means.

The device preferably further comprises retaining means by which the object to be lifted by the loader is more securely retained within the device. This is in addition to the simple retention of the object by the slot-entering jaw means and second jaw means acting against each other under the influence of the adjusting means.

More preferably, the slot-entering jaw means comprises a pair of spaced and parallel elongated rectangular slot-entering jaw members extending perpendicularly from a first portion of a supporting frame; and more preferably wherein each of said slot-entering jaw members is substantially wedge-shaped such that said jaw member is of less thickness at its end remote from said frame than said jaw member adjacent said frame.

It is not essential that each of the jaw members be wedge-shaped to permit entry of the member into the narrow slot available between the object to be lifted and an intimately adjacent object. However, for advantageous operation in prising open a narrow gap, typically, about ⅛" (3 mm) for a slot cut out of a concrete floor, we have found that a jaw member having an initial thickness of approximately ⅛" (3 mm) at its end is sufficient to prise away the object to be raised from an adjacent object to permit entry into the slot of the reminder of the more thicker jaw member while being sufficiently strong to withstand satisfactory lifting of the object.

The slot-entering jaw members are preferably of such a wedged form as to have an upper, horizontal surface perpendicularly of the frame and a lower inclined surface when the device has its jaw members substantially parallel to the ground when the device is in its vertical position.

Yet more preferably, each of the slot-entering jaw means and second jaw means are provided with an upstanding retaining tooth, whereby in operation the teeth retain within the device the object gripped and to be removed.

It is also a preferred feature of the loader and device combination that the loader has gripping device rotation means adapted to be received by the device whereby the device may be operably rotated from a horizontal position to a vertical position and back. The rotation means preferably comprises hydraulic means or pneumatic means.

In a further aspect, the invention provides a method of removing an object adjacent a second object by means of a front-end loader in combination with a gripping device comprising slot-entering jaw means, second jaw means adjustable relative to said slot-entering jaw means, second jaw adjusting means to effect movement of said second jaw means away from or towards said slot-entering jaw means, loader cooperation means by which said device is adapted to cooperate with said loader, which method comprises positioning said loader adjacent said object, positioning said slot-entering jaw means and said second jaw means around said object, activating said second jaw adjusting means to effect movement of said second jaw means towards said slot-entering jaw means to effect gripping of said object by both of said jaw means to provide a loaded device, raising said loaded device by means of said loader; and depositing said object at a desired location.

In a preferred method the invention provides a method as hereinbefore defined wherein said object is a rectangular concrete slab cut from an expanse of concrete constituting a floor of a multi-storey structure, and further comprising shoring up said expanse of concrete, cutting up all or a part of said expanse of concrete into a plurality of rectangular shaped concrete slabs separated from each other by slots, positioning said loader on said expanse of concrete adjacent a first concrete slab to be removed, inserting said slot-entering jaw means into a slot separating said first first concrete slab from an adjacent concrete slab, activating said second jaw adjusting means to effect movement of said second jaw means towards said slot-entering jaw means to effect gripping of said concrete slab by both of said jaw means to provide a loaded device, raising said loaded device by means of said loader, and depositing said concrete slab at a desired location.

BRIEF DESCRIPTION OF THE DRAWINGS

In order that the invention may be better understood a preferred embodiment will now be described by way of example only with reference to the accompanying drawings wherein.

DETAILED DESCRIPTION OF THE DRAWINGS

Figure 1:
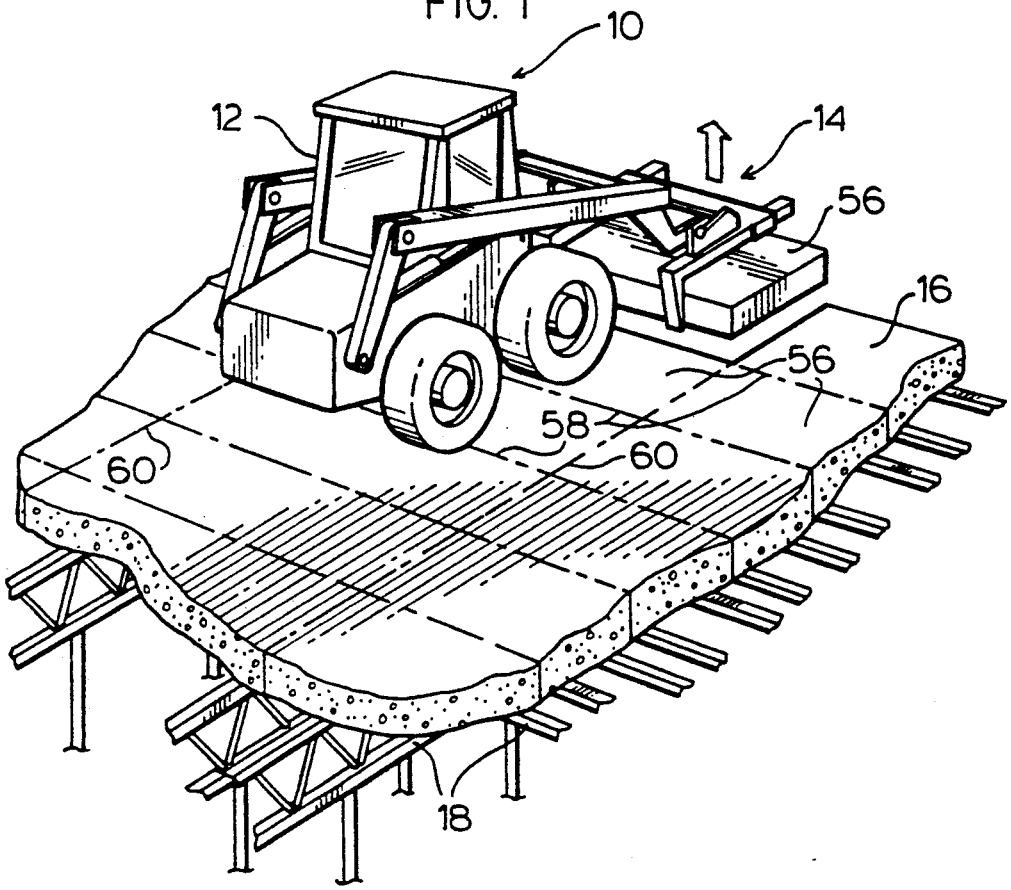
FIG. 1 is a perspective view of a front-end loader in combination with a gripping device according to the invention and positioned on a pre-cut concrete floor supported by shoring.

FIG. 1 shows generally as 10, a front-end loader 12, in combination with a gripping device shown generally as 14 positioned on a pre-cut floor 16 supported by shoring 18.

Figure 2:
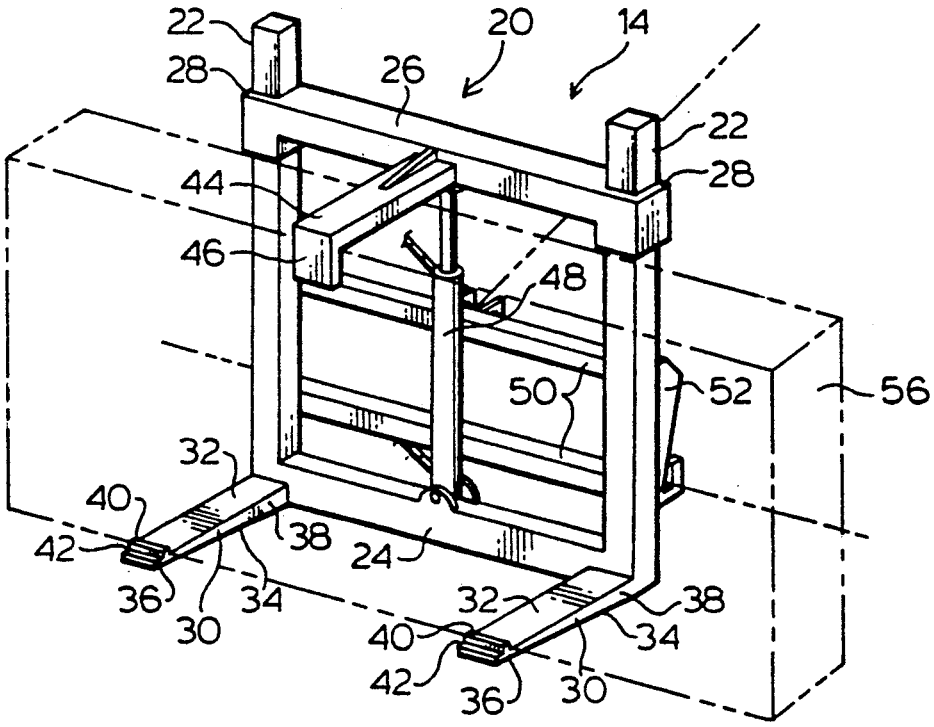
FIG. 2 is a perspective view of a gripping device according to the invention.

With particular reference to FIG. 2, device 14 comprises a substantially rectangular frame shown generally as 20 comprising a pair of parallel and spaced apart side supports 22 each integrally formed at a lower part thereof with a horizontal rigid member 24, and at an upper part with an adjustable horizontal member 26. Member 26 at each of its ends defines closed terminal apertures 28, each occupied by a support 22, and by which member 26 is retained between and adjustable upon supports 22.

Figure 5:
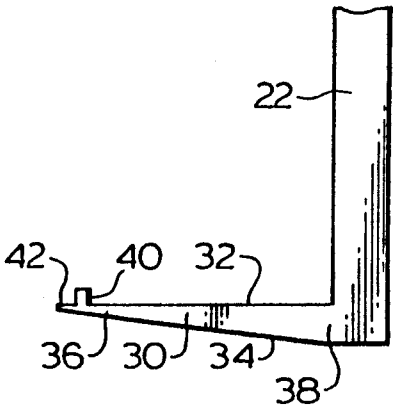
FIG. 5 is a diagrammatic side elevation of a lower portion of a gripping device according to the invention.

With reference also to FIG. 5, extending perpendicularly forward from a lower part of each of supports 22 is an elongated wedge-shaped, slot-entering lower jaw member 30. Each of the parallel and spaced apart members 30 has a substantially horizontal upper surface 32 and an inclined lower surface 34 such that members 30 are of less thickness at their ends 36 remote from frame 20 and support 22 then members 30 at parts 38 adjacent frame 20 and support 22. In the embodiment shown, parts 38 have a thickness of approximately 6" (15 cm), while the thin leading edge 36 of member 30 has a thickness of approximately ⅛" (3 mm).

Each of lower jaw members 30 has an upstanding rectangular retaining tooth 40 extending perpendicularly from surface 32 parallel to support 22 and proximate to, but not at, end 36 to provide a free, slot-engaging terminal portion 42.

Extending perpendicularly forward from a middle portion of adjustable horizontal member 26 is an elongated rectangular upper or second jaw member 44. Upper jaw member 44 is substantially parallel to lower jaw members 30.

Member 44 at its end remote from horizontal member 26 has an integrally formed extended tooth 46 extending downwardly parallel to supports 22 to oppose, generally, upstanding teeth 40. In the embodiment shown, teeth 40 are approximately 1½" (3.8 cm) in height and tooth 46 approximately 9" (23 cm) in height.

Frame 20 has a hydraulic piston 48 constituting second jaw adjusting means connected to rigid member 24 and adjustable member 26, whereby activation of piston 48 (by means not shown) effects movement of adjustable member 26 along supports 22 relative to rigid member 24 to effect movement of upper jaw member 44 away from or towards lower jaw members 30.

Frame 20 has a pair of cross-pieces 50 and side supports 52 partially constituting loader cooperation means by which the frame and attendant parts of gripping device 14 are adapted to cooperate with loader 12.

Figure 3:
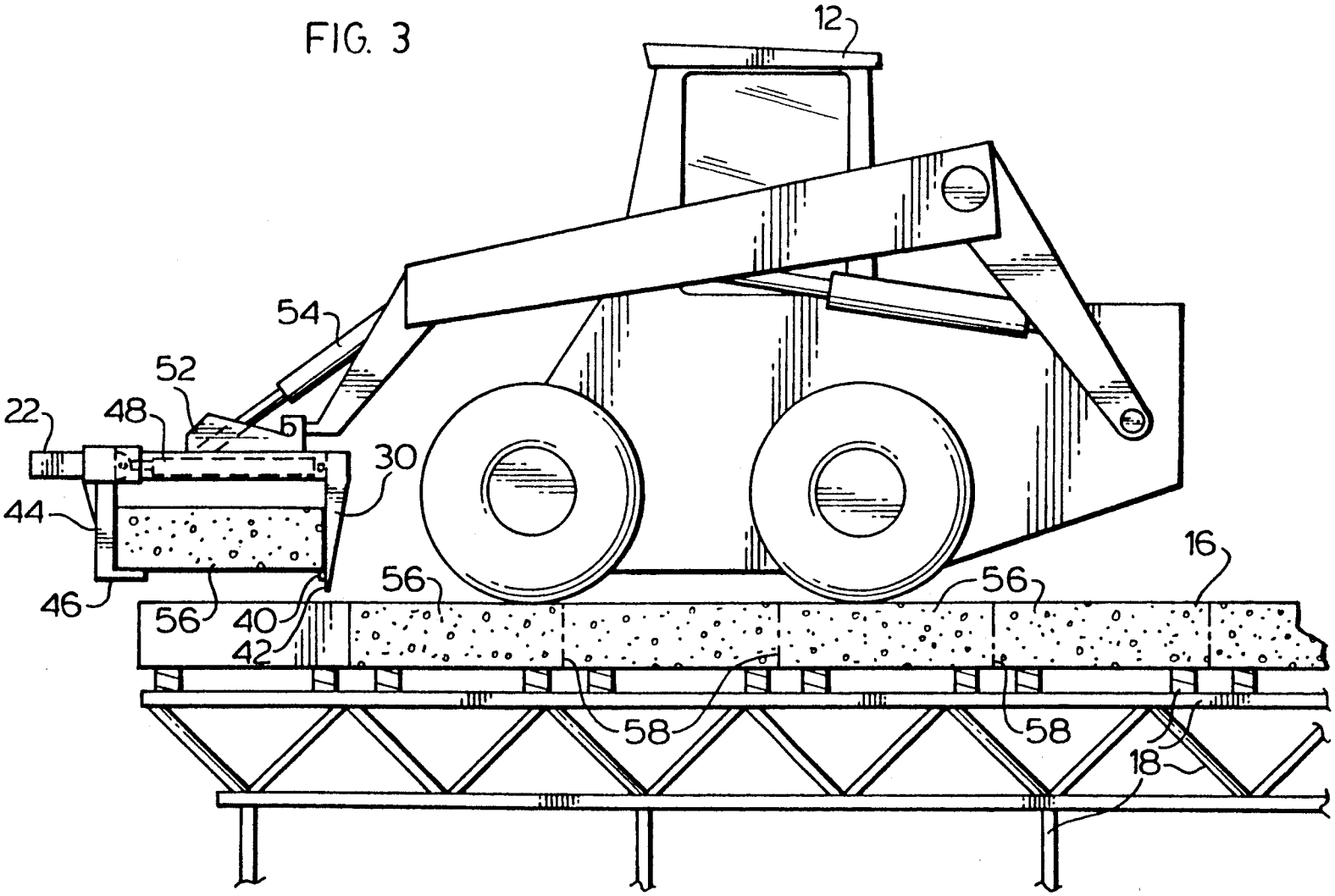
FIG. 3 is a diagrammatic side elevation of the combination of FIG. 1 with the gripping device in a lowered, horizontal position.
Figure 4:
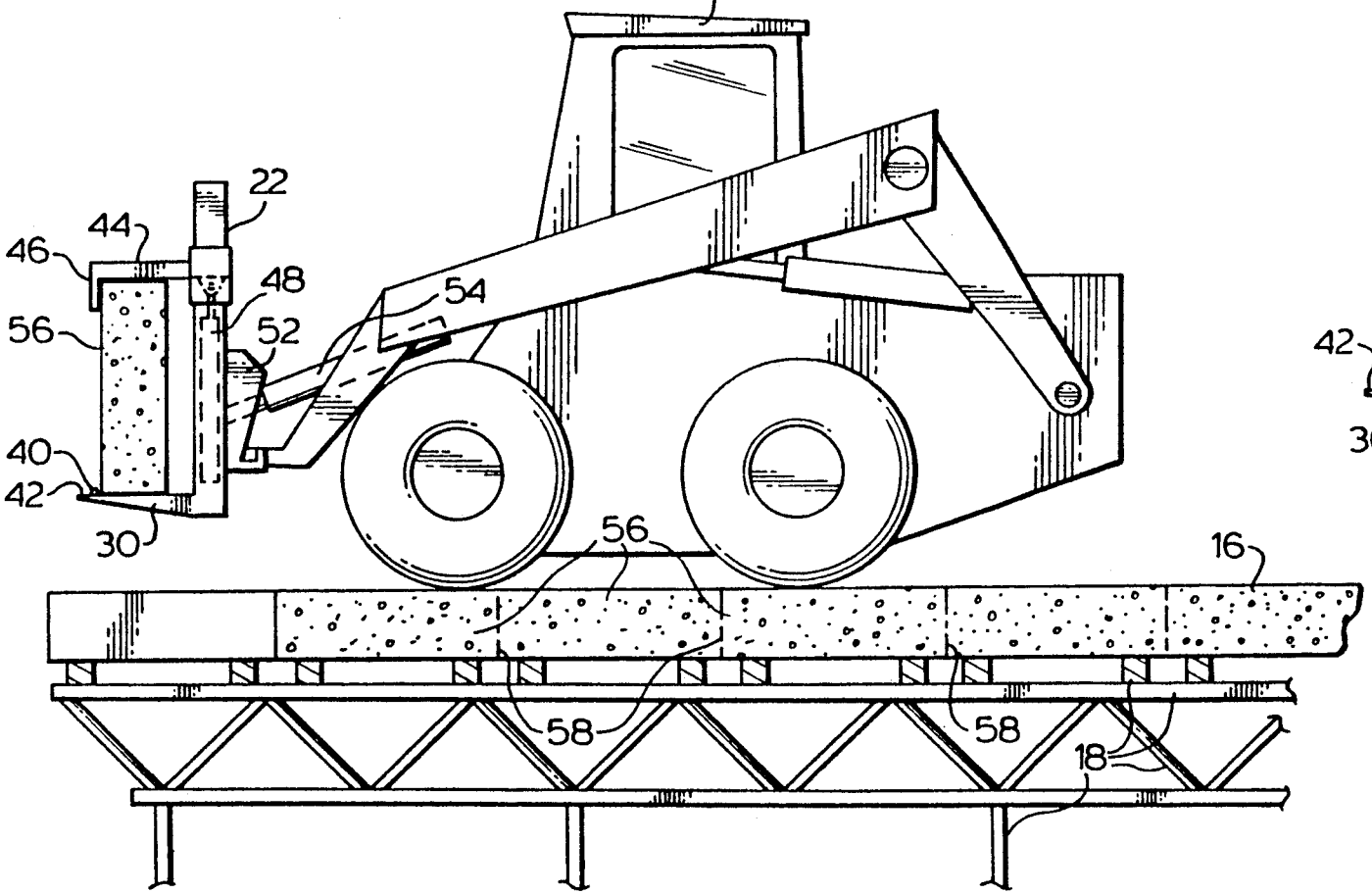
FIG. 4 is a diagrammatic side elevation of the combination of FIG. 3 with the gripping device in a partially raised, vertical position.

With particular reference to FIGS. 3 and 4, it is seen that loader 12 is connected to device 14 through cross-pieces 50 and side supports 52. Provided by loader 12 is a hydraulic piston 54, which constitutes gripping device rotation means by which device 12 may be rotated in a vertical plane about a horizontal axis.

Floor 16 has slabs 56 and 56' cut out of the expanse of concrete and separated by transverse vertical slots 58 and horizontal vertical slots 60. In the embodiment shown slabs 56 and 56' have dimension of approximately 8×3×8" (2.4 m×0.95 m×0.3 m) and separated one from the other by a distance of approximately ⅛" (3 mm).

Figure 6:
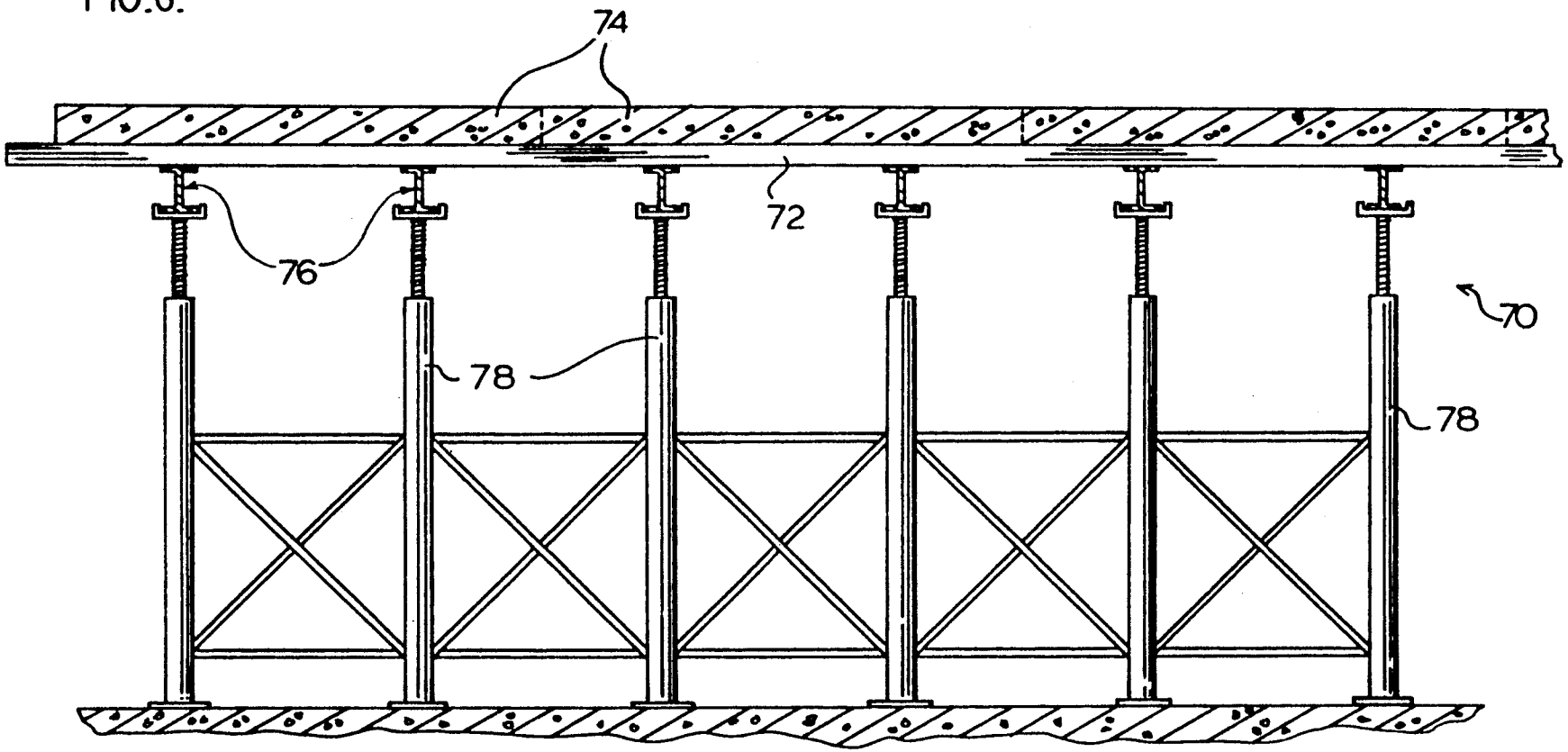
FIG. 6 is a schematic part section of a pre-cut concrete floor supported by shoring.

The expanse of concrete is shored-up by any suitable shoring means prior to cutting. In a preferred form shown in FIG. 6, the shoring shown generally as 70 comprises suitable lengths of 4"×4" (10 cm×10 cm) timber joists 72 abutting concrete 74 and supported on heavy duty aluminum I-beams 76 parallel to the intended long side of the slabs to the removed. I-beams 76 rest on heavy duty scaffold frame 78.

In operation, loader 12 is positioned on floor 16 adjacent slab 56 to be removed. It will be readily understood that there has to be sufficient room, initially, to permit entry of the second jaw around the first cut slab. Thus, a sufficient area of floor has to be removed, firstly, by means other than the device according to the invention. Device 14 is positioned horizontally above slab 56 with jaw members 30 and 44 extended apart to permit subsequent unhindered movement of tooth 46 to below slab 56. Device 14 is lowered until slot-engaging terminal portion 42 enters slot 58. With terminal portion 42 in slot 52, terminal portion 42 is moved forwardly so as to slide the slab 56 forwardly. Nudging of slab 56 by members 30 is effected to provide a slightly enlarged slot 58 to permit entry of teeth 40. Subsequent, forceful lowering of device 14 in a horizontal position as a whole causes members 30 to prise open slot 58 to the width of members 30 until teeth 40 are below slab 56. Activation of hydraulic piston 48 brings member 44 towards members 30 until members 30 and 44 abut slab 56 with teeth 40 and 46 underneath slab 56.

Device 14 in the horizontal position is raised clear of floor 16, as shown in FIG. 3, by loader 12 with slab 56 retained within device 14 between members 30 and 44 on teeth 40 and 46.

Rotation of device 14 from the horizontal position to a vertical position, as shown in FIG. 4, is carried out by means of the loader 12 activating hydraulic piston 54. Device 14 and slab 56 may be raised to a desired higher level, either before or after rotation to the vertical position. The rotational feature as hereinbefore described provides an important advantage in that it enables the gripping device adapted to receive such rotational means, to retain and transport the slab in a more favourably secure stance. More of slab 56 rests on the lower slot-entering jaw members when device 14 is in the vertical position than does slab 56 when resting on retaining teeth 40 and 46 when device 14 is in the horizontal position.

Loader 12 transports device 14 and slab 56 to a desired location where device 14 is rotated back to its horizontal position, lowered and piston 48 activated to effect movement of member 44 away from member 30 and release of slab 56.

In an alternative but less preferred embodiment, members 30 have parallel upper and lower surfaces and, thus, constitute elongated rectangular slot-entering members.

Provided that the slot-entering members can, in fact, conveniently enter the slot sufficiently to enable passage of the member down the slot with or without the need for slot widening action, such as by nudging and the like, by the member, the member can be of any suitable shape. However, regard must be had, also, to the shape of the slot-entering member as a base for the carried object when the device is in the vertical position.

It will be appreciated that each of the opposing jaw means may constitute slot-entering means, optionally provided with retaining means. However, for safety reasons, it is preferred that one of such jaw means has a significantly larger retaining means, to safely retain the object, than the other jaw means and, thus, is not overly practicable as a slot-entering jaw means.

It is also within the scope of the present invention that the slot-entering jaw means be of an inverted wedge-shaped form wherein the inner surface of the means be inclined and its outer or lower surface parallel to the upper jaw means.

Thus, the invention generally provides a rotatable gripping and retaining device having a pair of holding jaws, at least one so suitably shaped as to permit entry between narrow slots of adjacent, substantially flat-faced objects wherein the jaws are substantially parallel, one jaw moveable relative to the other, and provided with teeth which act as horizontal retaining means when the device is horizontal and as vertical retaining means when the device is vertical.

Thus, in one aspect the present method and apparatus provide an improvement by which a concrete floor of a multi-storage parking garage and the like can be rehabilitated.

The perimeter walls and supporting columns of the floor must be restrained laterally by means of bracing at least below the slab to be removed, if full shoring of the floor is not done. Such bracing allows only limited movement by a fork lift truck if operative on the floor below. Removal of the slab from below, accordingly is relatively time consuming.

Where lateral bracing of walls and columns are provided above the slab to be removed and bracing diagonally attached to the roof slab, interference with movement of the fork lift truck is reduced. However, the lateral bracing in this case interferes with slab replacement procedures, including the pouring of concrete for the new floor.

In the method of the present invention, more time is spent, initially, to preshore the entire level or a substantial phased area to be rehabilitated. At the same time the structure between the shoring is laterally braced along column lines and provided with diagonal frames along perimeter walls. This manner of support is all below the floor to be removed. Thus, advantages result from this method. The structure is safely supported from a lateral bracing aspect and without obstructions on the operating level. This results in a recuperation of earlier lost time and a speedier conclusion to the full rehabilitation project.

It can be readily seen that the shoring already in place for supporting the cut concrete floor can be used for supporting the new formwork, typically formed of plywood when the old floor has been removed. Any reinforcing steel can be more readily installed and the concrete pouring carried out in a relatively shorter period of time.

Although this disclosure has described and illustrated certain preferred embodiments of the invention, it is to be understood that the invention is not restricted to these particular embodiments. Rather, the invention includes all embodiments which are functional or mechanical equivalents of the specific embodiments and features that have been described and illustrated herein.

What I claim is:

1. A gripping device for use in combination with a front-end loader in gripping and lifting a heavy object, said device comprising:

a supporting frame;

slot-entering jaw means connected to said supporting frame;

second jaw means adjustable relative to said slot-entering jaw means;

second jaw adjusting means to effect movement of said second jaw means away from or towards said slot-entering jaw means; and loader cooperation means by which said device is adapted to cooperate with said loader, wherein said slot-entering jaw means comprises a pair of spaced and parallel elongated rectangular slot-entering jaw members extending perpendicularly from a first portion of said supporting frame, wherein each of said slot-entering jaw members is substantially wedge-shaped such that said jaw member is of less thickness at its end remote from said frame than adjacent said frame, and wherein each of said slot entering jaw members has an upstanding retaining tooth extending therefrom, proximate to, but not at, said end remote from said frame, to provide a free slot-engaging leading edge.

2. A gripping device as claimed in claim 1 wherein each of said wedge-shaped slot-entering jaw members has an upper surface extending perpendicularly from said first portion of said supporting frame.

3. A gripping device as claimed in claim 1 wherein said second jaw means comprises a second elongated rectangular jaw member extending perpendicularly from a second portion of said frame and parallel to said slot-entering jaw members.

4. A gripping device as claimed in claim 3 wherein said second jaw member has extending perpendicularly therefrom adjacent its' end remote from said frame a second upstanding retaining tooth.

5. A gripping device for use in combination with a front-end loader in lifting heavy objects, said device comprising:

(i) a frame having; a pair of parallel side supports; an adjustable horizontal member retained between and slidable on said side supports; and a rigid member connected to and intermediate said pair of parallel side supports; said rigid member being spaced from said horizontal member;

(ii) a pair of spaced and parallel elongated wedge-shaped, slot-entering lower jaw members, extending forward perpendicularly from said side supports at lower parts thereof, one lower jaw member from each side support;

(iii) an elongated rectangular upper jaw member extending perpendicularly forward from said horizontal member and parallel to said lower jaw members; wherein each of said lower jaw members has an opposing upper surface which opposes and is parallel to said upper jaw member;

(iv) a retaining tooth extending perpendicularly from each of said opposing surfaces of said lower jaw members and proximate to, but not at, the end thereof remote from said frame to provide a free slot-engaging terminal portion;

(v) an extended tooth extending perpendicularly from said upper jaw member adjacent the end thereof remote from said horizontal member and opposing said teeth of said lower jaw members, wherein said extended tooth is of greater length than the length of said retaining teeth of said lower jaw members;

(vi) hydraulic or pneumatic piston means cooperable with said horizontal member and said rigid member, wherein operable activation of said piston means effects movement of said adjustable horizontal member relative to said rigid member to effect movement of said upper jaw member either away from or towards said lower jaw members; and (vii) loading cooperation means by which said device is adapted to cooperate with said loader.

6. A method of removing a rectangular concrete slab cut from an expanse of concrete constituting a floor of a multi-story structure by means of a front-end loader in combination with a gripping device comprising:

slot-entering jaw means;

second jaw means adjustable relative to said slot entering jaw means;

second jaw adjusting means to effect movement of said second jaw means away from or toward said slot-entering jaw means;

loading cooperation means by which said device is adapted to cooperate with said loader;

said method comprising:

shoring up said expanse of concrete;

cutting up all or a part of said expanse of concrete into a plurality of rectangular-shaped concrete slabs separated from each other by slots;

positioning said loader on said expanse of concrete adjacent a first concrete slab to be removed with said device in a horizontal position with said slot-entering jaw means disposed vertically and above a slot separating said first concrete slab from an adjacent concrete slab;

inserting said slot-entering jaw means into said slot;

activating said second jaw adjusting means to effect movement of said second jaw means towards said slot-entering jaw means to effect gripping of said concrete slab by both of said jaw means to provide a loaded device;

raising said loaded device by means of said loader; and depositing said slab at a desired location.

7. A method as claimed in claim 6 further comprising:

partially inserting said slot-entering jaw means into said slot;

nudging said slab to effect widening of said slot; and lowering said device to effect further widening of said slot to receive substantially the whole of said slot-entering jaw means.

* * * * *